US005549310A

United States Patent [19]

Meibock et al.

[11] Patent Number: 5,549,310

[45] Date of Patent: Aug. 27, 1996

[54] IN-LINE ROLLER SKATE WITH IMPROVED FRAME ASSEMBLY

[75] Inventors: Antonin A. Meibock, Cleveland, Ohio; John E. Svensson, Seattle, Wash.

[73] Assignee: K-2 Corporation, Vashon, Wash.

[21] Appl. No.: 179,302

[22] Filed: Jan. 10, 1994

Related U.S. Application Data

[63] Continuation-in-part of Ser. No. 94,576, Jul. 19, 1993, Pat. No. 5,437,466, and Ser. No. 100,745, Aug. 2, 1993, abandoned, and Ser. No. 120,629, Sep. 13, 1993, Pat. No. 5,452,907.

[51] Int. Cl.[6] ..... A63C 17/02

[52] U.S. Cl. ..... 280/11.22; 280/11.27; 280/11.31

[58] Field of Search ..... 280/11.22, 11.27, 280/11.3, 11.31, 11.23, 7.12

[56] References Cited

U.S. PATENT DOCUMENTS

| | | | |
|---|---|---|---|
| 310,923 | 1/1885 | Wardwell . | |
| D. 321,393 | 11/1991 | Olson et al. | D21/226 |
| D. 323,540 | 1/1992 | Graham | D21/225 |
| D. 324,713 | 3/1992 | Rubin | D21/226 |
| D. 334,225 | 3/1993 | Graham | D21/226 |
| 916,289 | 3/1909 | Fitzgerald . | |
| 1,527,840 | 2/1925 | Chomin | 280/11.22 |
| 1,726,579 | 9/1929 | Oestrick . | |
| 1,798,590 | 3/1931 | Collis . | |
| 1,868,548 | 7/1932 | Turner . | |
| 2,118,892 | 5/1938 | Mays | 280/11.3 |
| 2,147,455 | 2/1939 | Murray | 280/11.3 |
| 2,290,523 | 7/1942 | Bauer | 280/11.27 |
| 2,868,553 | 1/1959 | Rieckman | 280/11.27 |
| 2,909,375 | 10/1959 | Warner | 280/11.2 |
| 2,998,260 | 8/1961 | Meyer | 280/11.3 |
| 3,287,023 | 11/1966 | Ware . | |
| 3,387,852 | 6/1968 | De Sarro | 280/11.26 |
| 3,526,976 | 9/1970 | Jacobs | 280/11.3 |
| 3,901,520 | 8/1975 | McMahan | 280/7.13 |
| 3,999,772 | 12/1976 | Brennan | 280/11.23 |
| 4,058,324 | 11/1977 | Dallaire | 280/11.22 |
| 4,108,451 | 8/1978 | Scheck, Sr. | 280/11.2 |
| 4,298,209 | 11/1981 | Peters . | |
| 4,345,774 | 8/1982 | Poe et al. . | |
| 4,468,045 | 8/1984 | Sarazen . | |
| 4,492,385 | 1/1985 | Olson | 280/7.13 |
| 4,657,265 | 4/1987 | Ruth | 280/7.13 |
| 4,666,169 | 5/1987 | Hamill et al. | 280/11.23 |
| 4,909,523 | 3/1990 | Olson | 280/11.2 |
| 4,932,675 | 6/1990 | Olson et al. | 280/7.13 |
| 4,988,122 | 1/1991 | Saunders | 280/841 |
| 5,028,058 | 7/1991 | Olson | 280/11.22 |
| 5,046,746 | 9/1991 | Gierveld | 280/11.22 |
| 5,048,848 | 9/1991 | Olson et al. | 280/11.22 |
| 5,068,956 | 12/1991 | Malewicz | 29/437 |
| 5,092,614 | 3/1992 | Malewicz | 280/11.22 |
| 5,290,065 | 3/1994 | Kassal | 280/11.22 |
| 5,380,020 | 1/1995 | Arney et al. | 280/11.22 |

FOREIGN PATENT DOCUMENTS

| | | | |
|---|---|---|---|
| 812169 | 8/1951 | Germany | 280/11.26 |
| WO92/11908 | 7/1992 | WIPO . | |

*Primary Examiner*—Christopher P. Ellis
*Attorney, Agent, or Firm*—Christensen O'Connor Johnson & Kindness PLLC

[57] ABSTRACT

An in-line roller skate having an interchangeable frame assembly. The boot of the skate includes a base having a heel and a sole. The sole includes a downwardly extending peg and the heel includes a downwardly extending hook. The peg and hook engage and align a sole bracket and a heel bracket, respectively, when they are attached to the boot. The sole bracket and heel bracket include downwardly extending walls having slots that receive fasteners in order to releasably attach two opposing parallel frames. In-line roller wheels are rotatably mounted within the frames. The slots in the heel and sole brackets allow the frames to be longitudinally displaced forward or backward with respect to the boot, thus allowing the user to adjust the performance of the skate. The frames may also be removed from the boot and replaced with frames of differing designs and configurations in order to allow the skater to change the performance of the skate.

7 Claims, 6 Drawing Sheets

IN-LINE ROLLER SKATE WITH IMPROVED FRAME ASSEMBLY

RELATED APPLICATION

This is a continuation-in-part of U.S. applications Ser. Nos. 08/094,576 filed Jul. 19, 1993; U.S. Pat. No. 5,437,466; 08/100,745, filed Aug. 2, 1993, now abandoned, and 08/120, 629, filed Sep. 13, 1993, U.S. Pat. No. 5,452,907, the contents of which are incorporated by reference.

FIELD OF THE INVENTION

This invention relates generally to in-line roller skates and more specifically to an improved method and apparatus for mounting the wheel frame of an in-line skate to the boot.

BACKGROUND OF THE INVENTION

In-line roller skates include multiple wheels all rotating in a common plane such that a single row of wheels is created beneath each foot of the skater. This construction provides a skater with much of the same feel experienced on an ice skate, while the in-line roller skate may be used on a much wider variety of terrain.

Typical in-line skates include four wheels of the same size having axes of rotation within the same horizontal plane parallel to the riding surface. All the wheels are carried and rotatably supported within a lower frame that is attached to the base of a shoe or boot. The frame configuration determines the number, size, and location of the in-line wheels used with the skate. Frame configuration also determines whether advanced features such as "rocketing" axles and brakes can be used.

The frame and the base of the boot are generally integrally molded as a single piece or are permanently fastened together by riveting or bonding. Such an integral structure prevents a user from adjusting the location of the frame with respect to the boot or from removing and exchanging one set of frames for another set of frames of a different configuration. It is important that a purchaser consider all of the various options available on in-line skates because it is generally not possible to add or change features after purchase. Thus, a beginning skater typically purchases an in-line skate designed for beginners and must upgrade to a different in-line skate as his ability improves or he desires more advanced features.

An average recreational skater is usually satisfied with the performance of a standard in-line roller skate and is not concerned with exchanging or upgrading the parts of the roller skate to improve performance. However, advanced skaters may benefit from the ability to exchange the wheels, axles, or frames for those of different configurations depending upon the terrain or intended skating activity.

Skaters of differing abilities benefit from a different placement of the frame, and thus wheels, longitudinally along the length of a boot. A skater that desires a greater degree of toe push benefits from shifting the frame forward toward the toe of the boot while less aggressive skaters may favor shitting the frame rearward toward the heel of the boot. Depending upon the terrain, a skater may also benefit from increasing the length of the flame and thus the wheelbase to increase stability. Some skaters desire the ability to attach frames having an extremely long wheelbase and an increased number of wheels to simulate ski training.

Racers generally use skates having five wheels, while stunt skaters use skates having four wheels. In some applications, it is beneficial to minimize the profile of the frame and wheels so that the bottom of the boot is closer to the skating surface. A stunt skater may also wish to change the vertical alignment of the wheels into several different configurations, depending upon the type of stunts to be performed. For example, the front and rear wheels may be raised above the level of the middle wheels to provide a "rockering" effect. A skater having "rockered" wheels more closely parallels the feel of a hockey-style skate and may be used for more stunts and maneuvers. Some skaters also desire active braking systems to assist them in stopping. Unfortunately, current in-line skates do not offer all of the above-mentioned features on a single skate, thus a user is forced to settle for an in-line skate incorporating only some of the features they desire.

The base of the boot and the frame are generally integrally molded or permanently attached, thus separate tooling is required to form boots having a different sized base or frame. The tooling used to manufacture in-line skates is not universally interchangeable between any boot size and frame combination. Noninterchangeability of tooling increases the capital expense of the manufacturer and the complexity of the assembly process. The integral boot and frame combination also limits the interchangeability of the pans of the in-line roller skate. Thus, the manufacturer is forced to offer numerous different in-line skate designs including different features in order to please its customers.

From the manufacturer's point of view, it may be desirable to produce a universal boot design that can be used with any frame design. Such a boot would allow the manufacturer to change the boot design or the frame design independently without making corresponding changes in the other parts of the in-line skate. It may also be beneficial to produce an in-line skate having a frame that can be easily removed and exchanged, thus allowing the manufacturer to sell upgraded frame designs or advanced options to purchasers.

Another disadvantage of prior an skate designs is the complexity of attaching the frame to the boot. As discussed above, some boots incorporate the frame integrally within the base of the boot. Other skate designs permanently bolt or otherwise fasten the frame to the base of the boot. Failure to carefully align the boot and the frame during mounting can introduce alignment errors that affect the skate's performance. Generally, manufacturers use complex aligning jigs to hold both the boot and frame in alignment while holes are drilled in the bottom of the boot and frame to accommodate fasteners. To reduce the need for complex jigs it would be beneficial for the base of each boot to include a built-in alignment structure. Such a structure would ensure that frames would be properly aligned during drilling and fastening operations.

The present invention was developed to overcome some of the disadvantages with the prior art identified above. As will be understood from the following discussion, the present invention provides significant advantages over prior art in-line skates by providing an in-line skate that allows the frames to be interchanged without purchasing new skates. The present invention also allows the longitudinal location of the flames to be adjusted and provides an alignment structure to ensure that the frames are properly positioned on the base of the boot.

SUMMARY OF THE INVENTION

The present invention allows the frame on an in-line roller skate to be removed, thus allowing it to be interchanged for frames of other configurations. This ability to exchange the frames allows the in-line skater to tailor the skates to his individual taste and ability. The present invention also reduces the complexity of mounting the frames and wheels on the boot of the in-line skate. The present invention's use of sole and heel brackets that cooperate with a peg and hook on the sole and heel of the boot automatically aligns the brackets and the frames when they are attached to the boot.

In one embodiment of the present invention, the in-line roller skate includes a boot adapted to support the skater's boot. The boot has a base that includes a sole and a heel. A peg protrudes downwardly from the sole and the hook protrudes downwardly from the heel. The peg engages and aligns the sole bracket when it is attached to the boot and the hook engages and aligns the heel bracket when it is attached to the boot. A frame having in-line wheels rotatably mounted within it releasably attaches to the sole and heel brackets.

In other embodiments of the invention, the frame is also slidably attached to the sole and heel brackets, thus allowing the frame to be moved forward and backward with respect to the boot. The sole and heel brackets include downwardly extending walls having slots in which the frames are slidably mounted. The sole bracket also includes a hole sized to cooperate with the peg while the heel bracket includes holes sized to cooperate with the hook.

A method of aligning and attaching a frame to an in-line roller skate is provided in another embodiment of the invention. An in-line roller skate boot including a base having a sole and a heel, a first protrusion extending downwardly from the sole, and a second protrusion extending downwardly from the heel is used. A drilling template having first and second holes is placed on the boot such that the first and second holes engage the first and second protrusions, thus aligning the drilling template on the boot. The drilling template is then used to drill mounting holes in the boot. After drilling the mounting holes, the drilling template is removed and the frame is attached to the boot with fasteners that pass through the frame and engage the mounting holes.

In still another embodiment of the present invention, a running assembly designed to attach to an in-line roller skate boot having a base including a sole, a heel, a first protrusion extending downwardly from the sole, and a second protrusion extending downwardly from the heel is provided. The running assembly includes a heel bracket having a hole adapted to engage the second protrusion in order to align the heel bracket on the boot The sole bracket also includes a hole that is adapted to engage the first protrusion in order to align the sole bracket on the boot. Opposing parallel frames are then attached to the sole and heel brackets.

BRIEF DESCRIPTION OF THE DRAWINGS

The foregoing aspects and many of the attendant advantages of the invention will be more readily appreciated as they become better understood by reference to the following detailed description and accompanying drawings, wherein.

DETAILED DESCRIPTION OF THE PREFERRED EMBODIMENT

Figure 1:
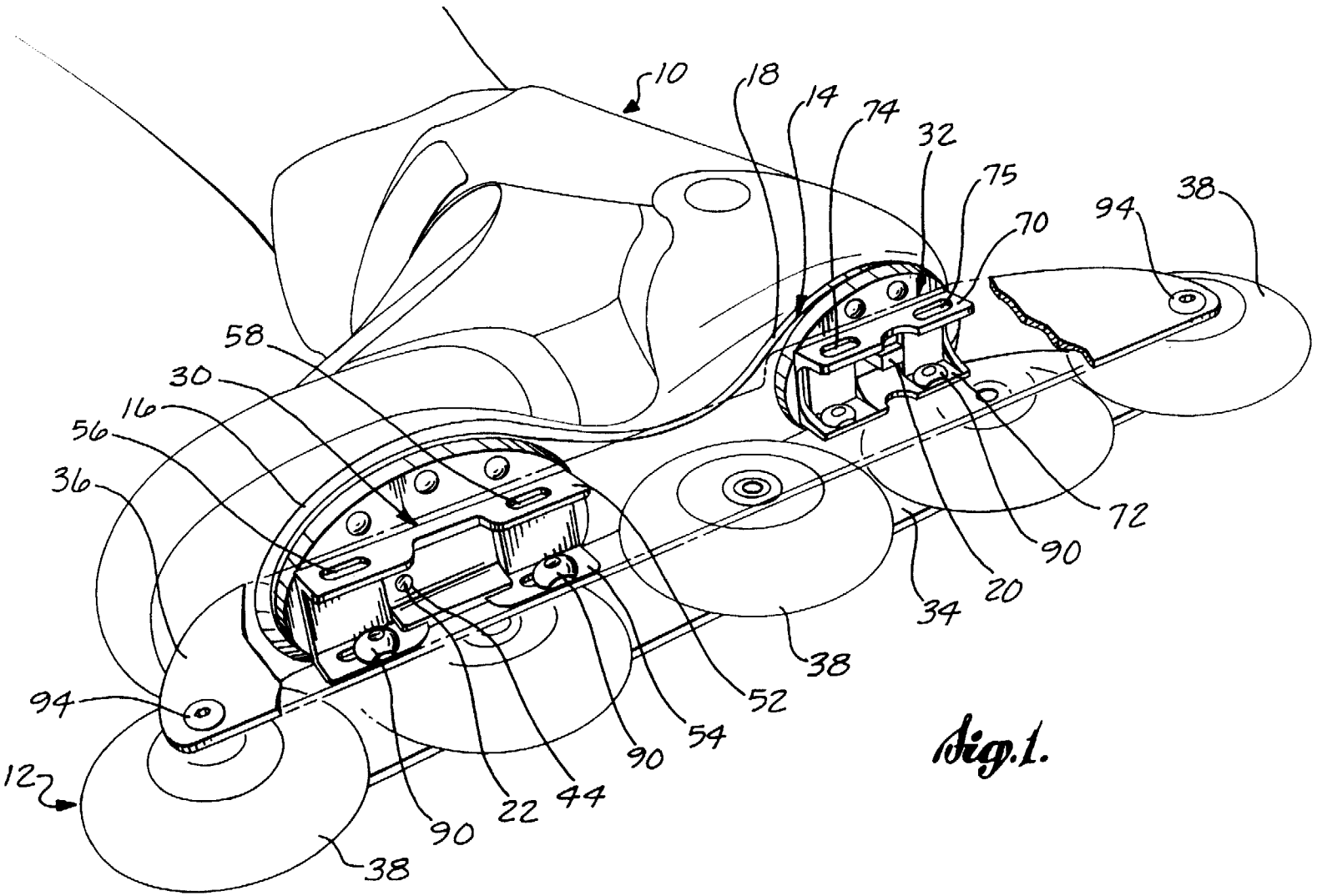
FIG. 1 is a partial cutaway perspective view of an in-line roller skate including an interchangeable frame attachment structure in accordance with the present invention.
Figure 2:
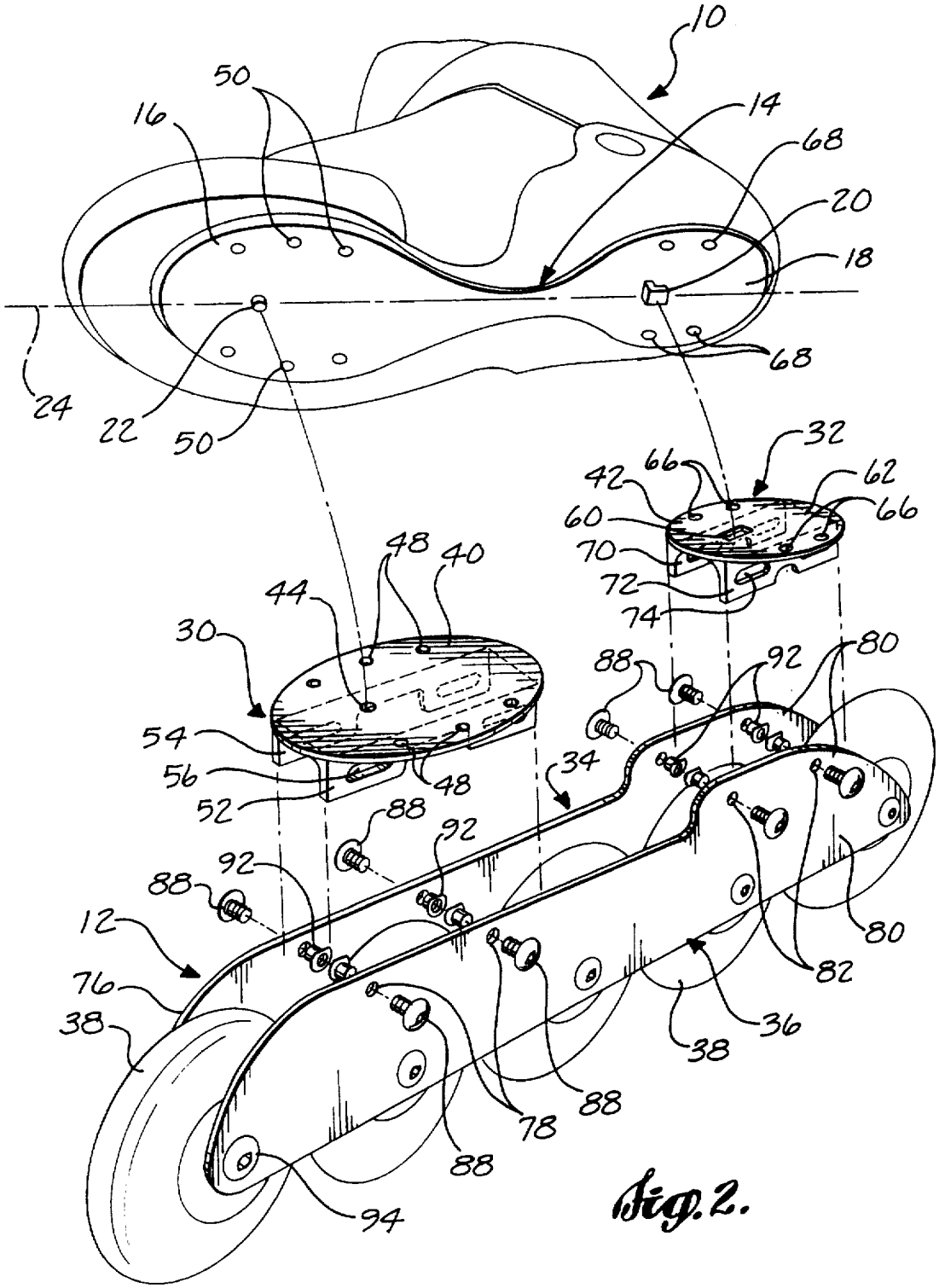
FIG. 2 is a partial exploded view of the skate and frame attachment structure of FIG. 1.

FIGS. 1 and 2 illustrate the details of a preferred embodiment of the invention including an in-line skate boot 10 and running assembly 12. The boot 10 includes a base 14 having a sole 16 and a heel 18. The base 14 is formed of a relatively stiff material capable of providing the structural support necessary to support the bottom of the boot and to serve as a mounting platform for the running assembly.

To align the running assembly 12 on the base as described in more detail below, the heel of the preferred embodiment includes a generally L-shaped hook 20 or other protrusion that extends downwardly from the bottom of the heel and rearwardly toward the rear of the heel. The sole includes a generally cylindrical peg 22 or other protrusion that extends downwardly front the bottom of the sole. Both the peg 22 and hook 20 are located along a central axis 24 extending over the length of the boot.

Although the preferred embodiment includes a peg and a hook, alternate embodiments could include two pegs, two hooks, or other protrusions extending downwardly from the sole and heel of the boot. In still other alternate embodiments, the sole and heel could include indentations or holes adapted to receive pegs or hooks extending upwardly from the running assembly as described in more detail below.

The running assembly 12 includes a sole bracket 30, a heel bracket 32, opposing frames 34 and 36 and a plurality of in-line roller wheels 38. The sole bracket and heel bracket 30 and 32 are adapted to attach to the sole and heel of the boot, respectively. The opposing frames 34 and 36 are attached to the sole and heel brackets and the wheels 38 are rotatably mounted within the opposing frames. Both the sole bracket and heel bracket include generally planar oval mounting surfaces 40 and 42, respectively, contoured to fit flush with the sole and heel of the boot.

As best seen in FIG. 2, the sole bracket 30 includes a hole 44 sized to engage the peg 22 on the sole of the boot. The engagement of the hole 44 and peg 22 ensures that the sole bracket is properly positioned along the centerline 24 of the boot and longitudinally along the length of the boot. The hole and peg also help align fastening holes 48 extending through the sole bracket with fastening holes 50 extending through the sole of the boot. The sole bracket is attached to the sole of the boot through the use of any suitable fastener extending through holes 48 and 50. The sole bracket may be permanently attached to the sole through the use of rivets or releasably attached through the use of fasteners such as screws or bolts (not shown).

Alternate embodiments of the present invention could include a peg located on the sole bracket in place of the hole. The peg would then engage a hole on the sole when the sole bracket is placed adjacent the boot.

Figure 3:
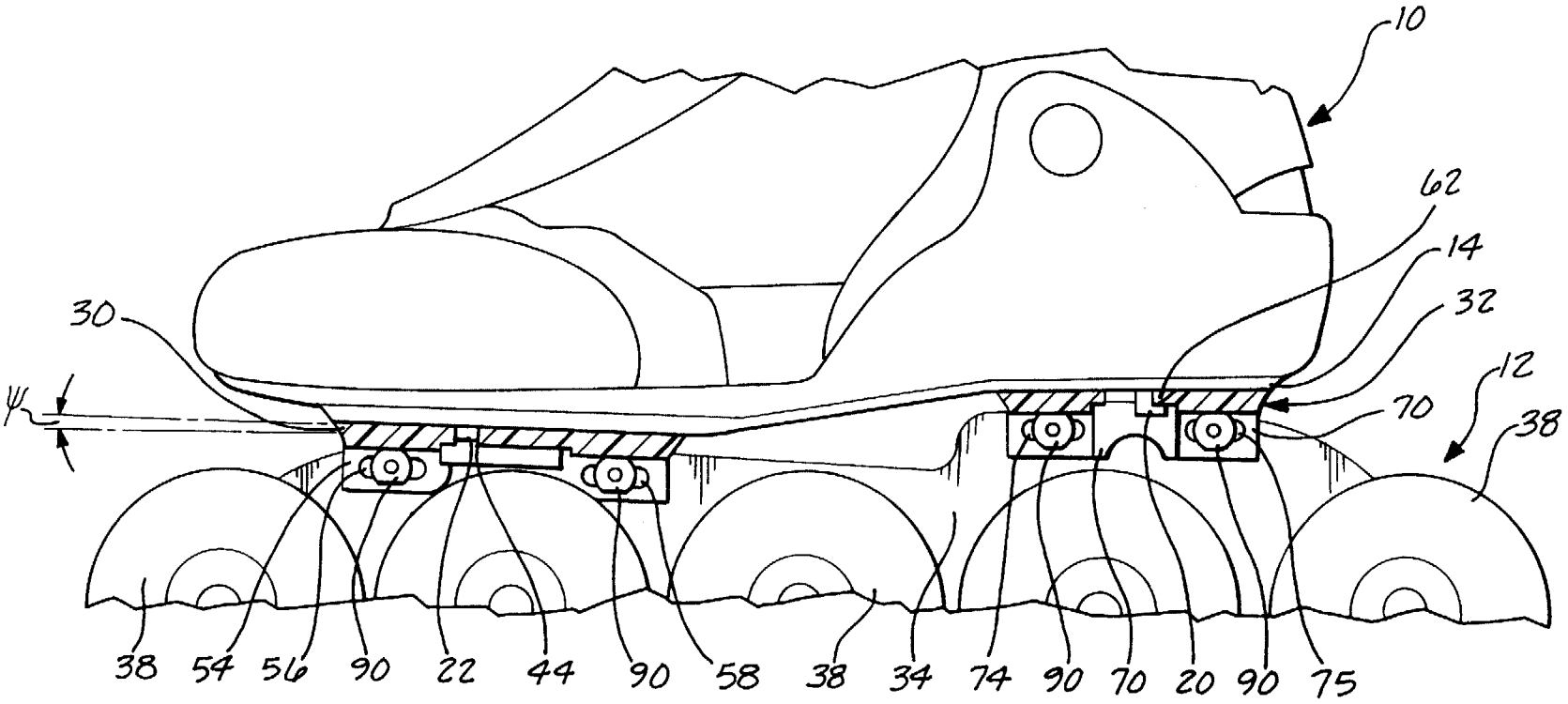
FIG. 3 is a partial cutaway side view of the attachment structure of FIG. 1.

As best illustrated in FIGS. 1 and 3, opposing parallel walls 52 and 54 extend downwardly from the mounting surface of the sole bracket along its length parallel to the central axis 24 when the sole bracket is attached to the boot. Each wall 52 and 54 includes two longitudinally spaced-apart slots 56 and 58. Slots 56 and 58 extend partially over the length of the walls. The slots are used to mount the frames to the sole bracket as described in ,greater detail below.

The heel bracket 32 includes a rectangular hole 60 located in the mounting surface 42 and sized to allow the hook 20 in the heel to extend through the hole when the heel bracket is placed adjacent the boot. To attach the heel bracket to the heel of the boot, the bracket is first placed adjacent the heel of the boot such that the hook 20 extends through the hole 60. The heel bracket is then slid forward toward the toe of the boot such that the L-shaped hook 20 engages the rear wall 62 of the hole 60, as best illustrated in FIG. 3. The hook 20 locates the heel bracket longitudinally along the length of the boot and aligns it along the centerline 24 of the boot.

In alternate embodiments, the hole 60 in the heel bracket could be replaced by an L-shaped hook or other protrusion. The hook would then engage a hole in the heel of the boot as opposed to the configuration shown in the preferred embodiment.

The heel bracket 32 is attached to the heel of the boot through the use of fasteners (not shown) that extend through holes 66 in the heel bracket and engage holes 68 in the heel portion of the boot. As with the sole bracket, the heel bracket may be permanently attached through the use of rivets or releasably attached through the use of screws or other suitable fastening devices. In a manner similar to that described with respect to the sole bracket, the heel bracket includes opposing parallel walls 70 and 72 extending downwardly from the mounting surface over the length of the heel bracket. The walls 70 and 72 extend parallel to the center axis 24 of the boot when the heel bracket is attached to the boot. Both walls 70 and 72 include two longitudinally spaced-apart slots 74 and 75. The slots 74 and 75 extend partially along the length of the walls and are used to attach the frame to the boot as described in detail below.

Each frame 34 and 36 includes a forward portion 76 having two longitudinally spaced-apart holes 78 located so as to correspond to the location of the slots 56 and 58 in the sole bracket when the frame is located adjacent the sole bracket. Each frame also includes a rear portion 80 having two holes 82 located so as to correspond with the slots 74 and 75 in the heel bracket when the frame is located adjacent the heel bracket.

Each frame is attached to the boot through the use of fasteners 88 that extend through the holes in the respective frame and slots in the respective sole or heel bracket. The fasteners engage retainers 90 located inside the walls of the brackets. Each retainer 90 includes a cylindrical portion 92 (FIG. 2) that extends through the slots in the heel and sole brackets. The present invention's use of retainers and slots in the heel and sole brackets allows the frames to be longitudinally displaced either forward or backward by loosening the fasteners and sliding the frames to the desired position.

Each fastener is shown in the preferred embodiment as a screw and retainer; however, any suitable releasable fastening device could be used. In alternate embodiments, a more permanent fastener such as a rivet could also be used.

In-line roller wheels 38 are rotatably mounted between the frames 34 and 36 through the use of axles 94 that extend through the frames and wheels. Any type of roller wheel and axle could be used, including axles that allow "rocketing" or movement of the individual wheels upwardly or downwardly within the frames.

The present invention's use of a peg on the sole of the boot and a hook on the heel of the boot ensures that the sole and heel brackets are properly aligned upon placement on the boot. The present invention also allows the sole and heel brackets to be formed separately from the boot, thus allowing them to be used interchangeably with different boot designs. Boot designs may be altered in any manner desired without altering the bracket or frame design as long as the contour of the sole and heel and the placement of the peg and hook remain fixed. The present invention allows different running assemblies to be used with the same boot as long as the sole and heel brackets are suitably configured to attach to the sole and heel of the boot. Thus, frames with varying lengths and dimensions, including options such as rocketing, wheel brakes, and differing numbers or sizes of wheels, can be used with the same boot.

The present invention's use of slots on the sole and heel brackets allows the frames to be moved forward or rearward to account for a skater's particular tastes and abilities. The present invention's use of removable frames also allows parts to be interchanged. Thus, a beginning skater could buy a pair of boots having a beginning running assembly and then replace individual parts of the running assembly to account for increased ability.

Figure 4:
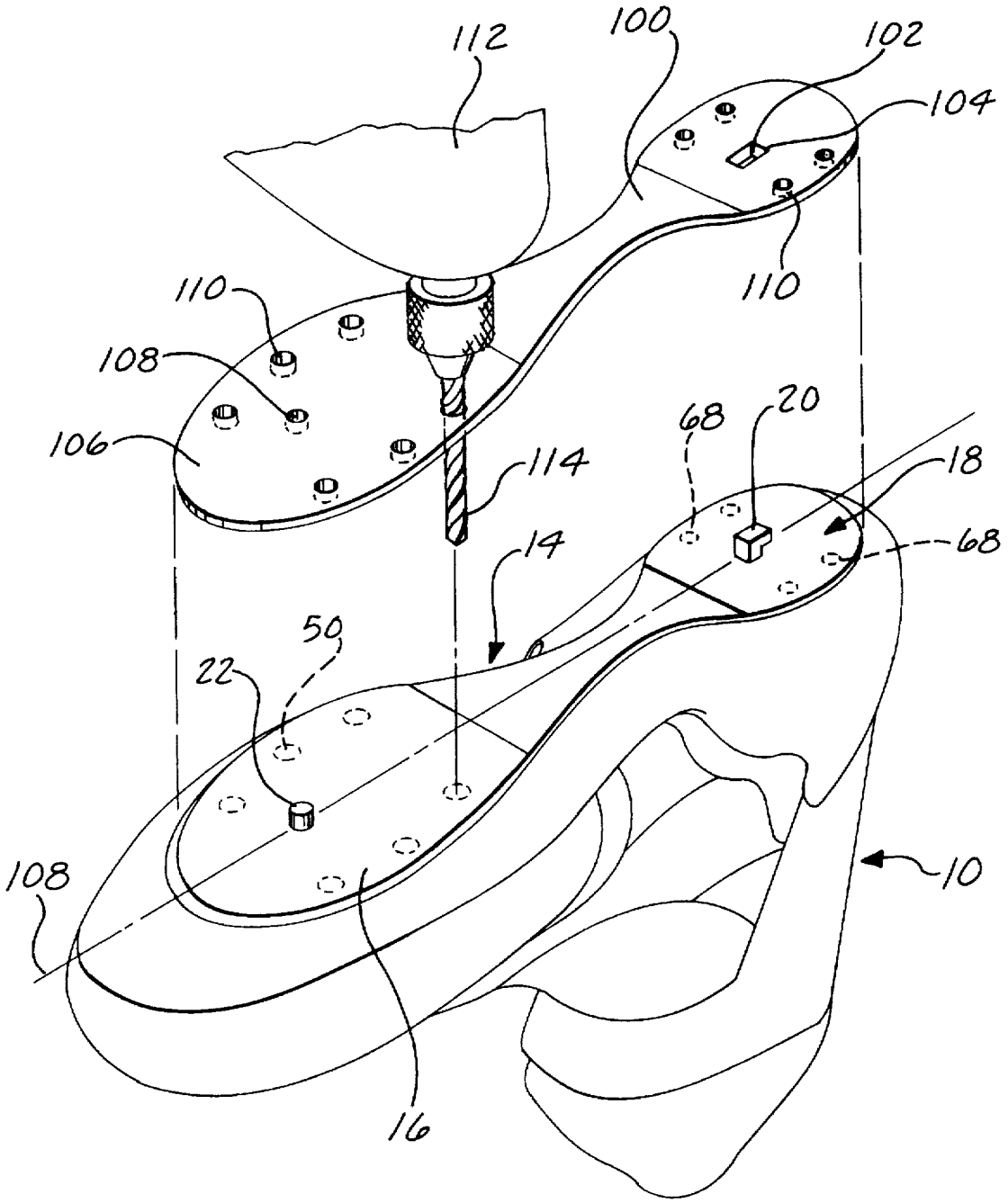
FIG. 4 is a perspective view of a drilling template for use in combination with the attachment structure of the present invention.

In addition to aligning the heel and sole brackets on the boot, the peg 22 and hook 20 also assist in locating and drilling holes 50 and 68 in the boot. As illustrated in FIG. 4, the peg 22 and hook 20 allow a drilling template 100 to be located and aligned on the base 14 of the boot. The drilling template 100 includes a rectangularly shaped hole 102 sized to allow the hook 20 to extend through the hole when the template is placed on the boot. In a manner similar to that described with respect to the heel bracket, the drilling template is placed on the boot and then slid forward so that the hook 20 engages the rear wall 104 of the hole 102. The sole portion 106 of the drilling template is then pressed toward the boot so that a hole 108 in the drilling template engages the peg 22 on the base of the boot. The combination of the peg and hook engaging the hole and slot in the template ensures that the drilling template is aligned both longitudinally and axially along the centerline 108 of the boot.

The drilling template includes a plurality of alignment guides or holes 110 located at its heel and sole. The alignment guides are positioned so that holes drilled into the base of the boot through the use of a drill and drill bit 112 and 114, respectively, are properly positioned to align themselves with holes in the heel and sole of the boot. The present invention's use of a peg and hook ensure proper hole alignment without the use of complex drilling jigs used in the prior art.

Another advantageous feature of the present invention is the placement of the sole and the heel brackets. As best illustrated in FIG. 3, the sole bracket is mounted on the sole of the boot so that the mounting surface slopes upwardly from the back of the bracket to the front of the bracket at an angle $\psi$. The base 14 of the boot is also configured so that the sole of the boot slopes upwardly from back to front at the same angle $\psi$. Due to the physiology of the human ankle and foot, the upward slope of the sole increases the skater's leverage.

Figure 5:
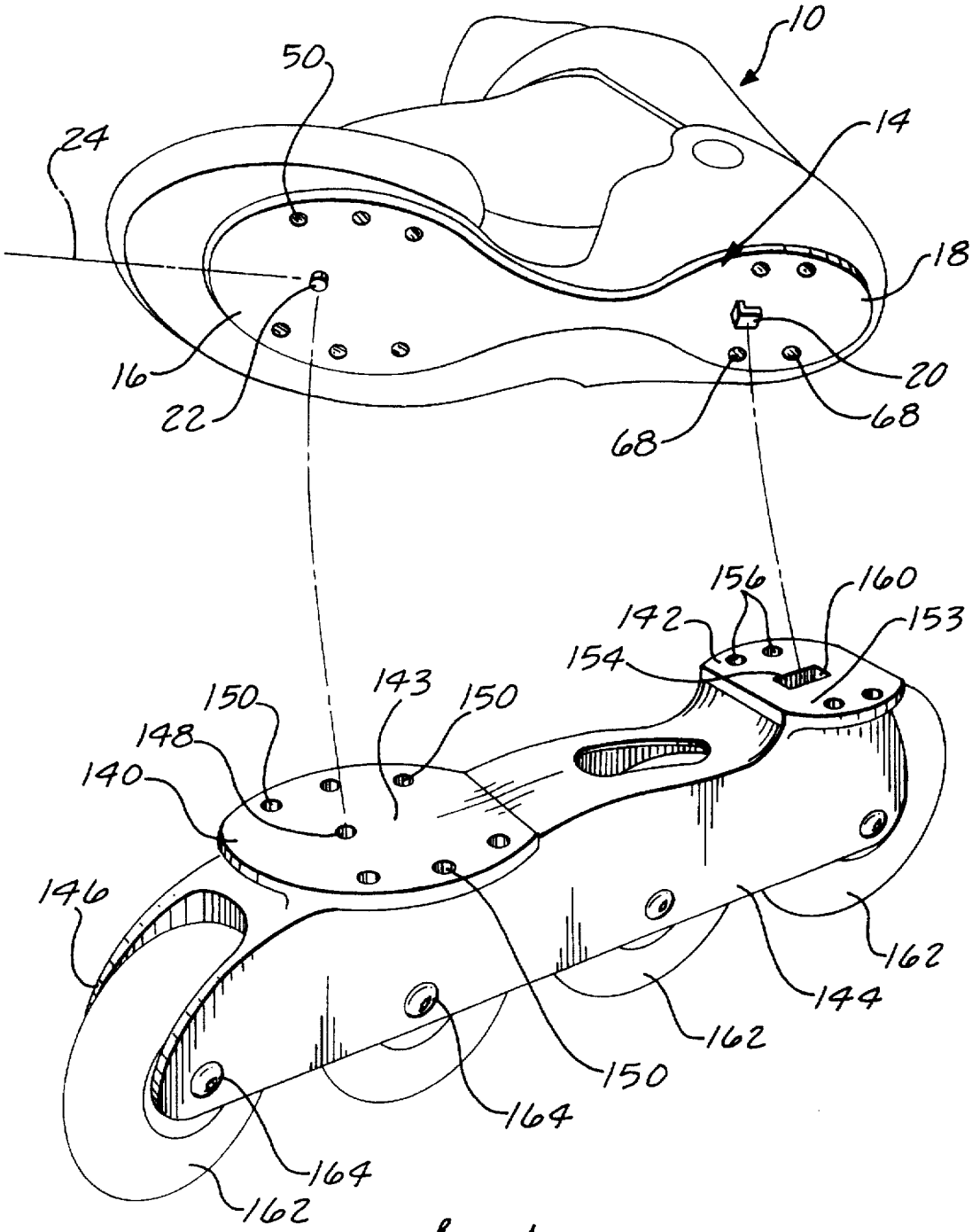
FIG. 5 is a partial exploded view of an alternate embodiment of a frame attachment structure in accordance with the present invention.
Figure 6:
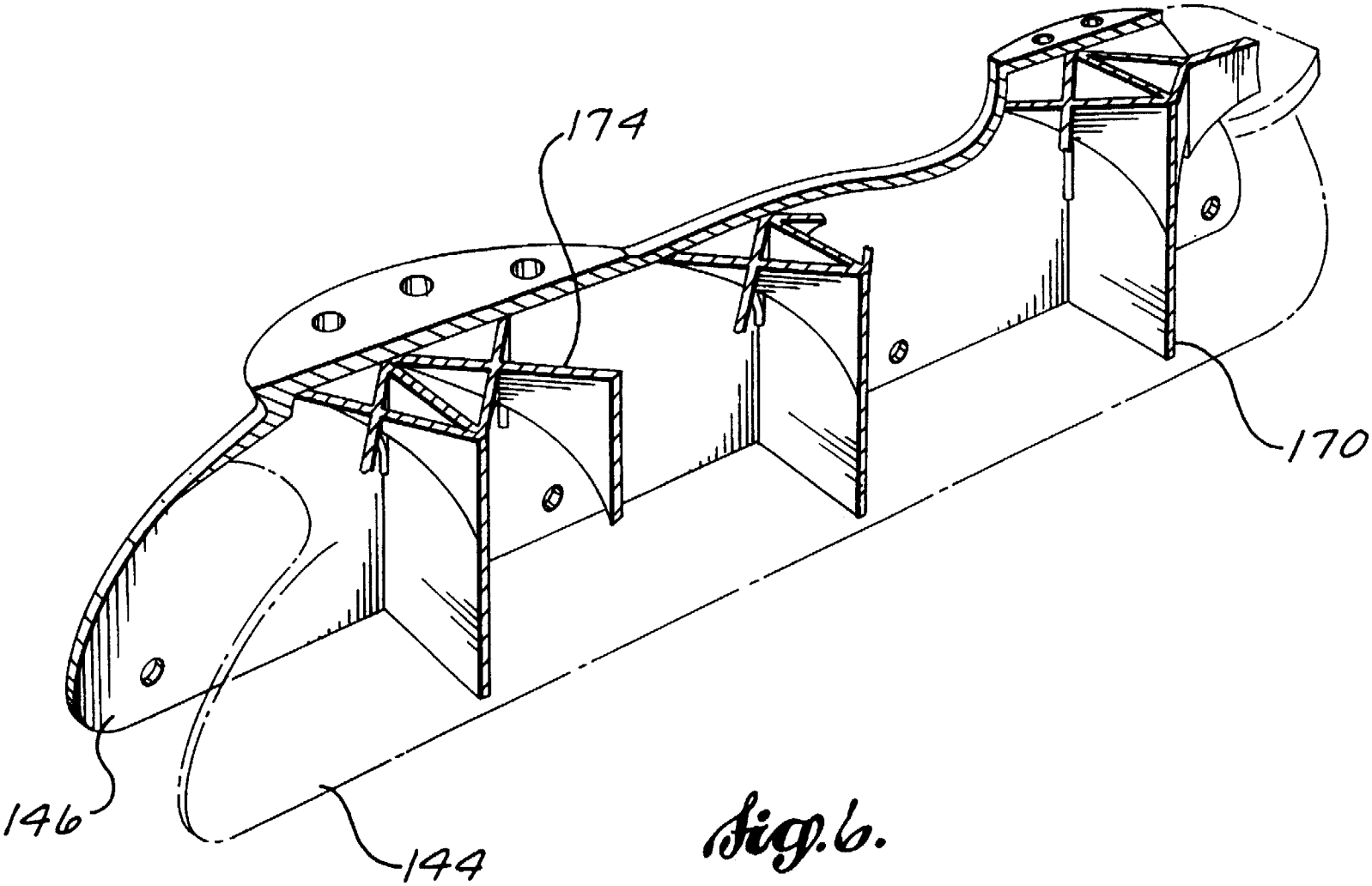
FIG. 6 is a cutaway view of the frame of FIG. 5.

A second embodiment of the present invention will now be described with reference to FIGS. 5 and 6. As with the description of the first embodiment, a boot 10 including a base 14 having a heel 18 and sole 16 is provided. In a manner similar to that described with respect to the first embodiment, a peg 22 extends downwardly from the bottom of the sole and a hook 20 extends downwardly from the bottom of the heel. Mounting holes 50 and 68 also extend through the sole and heel portions, respectively.

As opposed to the first embodiment's use of separate sole and heel brackets and opposing frames, the alternative embodiment includes a sole bracket 140 and heel bracket 142 integrally formed as part of opposing frames 144 and 146. In a manner similar to that described with respect to the first embodiment, the sole bracket 140 includes a mounting surface 143 having an alignment hole 148 and a plurality of mounting holes 150. The alignment hole 148 is sized to engage the peg 22 and the mounting holes 150 are located so as to correspond to the location of the mounting holes 50 on the base of the boot. The heel bracket 142 includes a mounting surface 153 having a rectangular hole 154 and a plurality of mounting holes 156. The rectangular hole 154 is sized to allow the hook 20 on the base of the boot to extend through the hole.

The combined assembly of sole, heel bracket, and frames is attached to the base of the boot by placing the heel bracket in contact with the heel of the boot such that the hook 20 extends through the rectangular hole 154. The combined assembly is then slid forward toward the toe of the boot until the hook 20 engages the rear wall 160 of the hole 154 in a manner similar to that described with respect to the first embodiment. The sole bracket is then pushed toward the sole of the boot such that the peg 22 extends into the hole 148. The peg 22 and hook 20 ensure that the combined assembly is properly aligned on the boot. The combined assembly is fastened to the base of the boot through the use of fasteners (not shown) extending through holes 150 and 156 in the sole and heel brackets and holes 50 and 68 in the sole and heel of the boot.

In-line roller wheels 162 are rotatably mounted between the frames 144 and 146 through the use of axle assemblies 164 in a manner well known in the art. The frames 146 and 144 are reinforced through the use of a series of transverse support walls 170 as illustrated in FIG. 6. The support walls 170 extend perpendicularly between the frames 144 and 146. Each support wall 170 is in turn reinforced through the use of X-shaped support trusses 174 that extend diagonally from the intersections between the support walls and one frame across to the opposite frame.

The alternate embodiment does not allow the high degree of exchangeability achieved in the preferred embodiment; however, it provides a more rigid and durable integral one-piece running assembly. Such a rigid running assembly is advantageous for skaters who intend to use skates on rough terrain and desire increased stiffness and durability or for a skater who does not require the advanced features available from the preferred embodiment.

While preferred embodiments of the invention have been illustrated and described, it will be appreciated that various changes can be made therein without departing from the spirit and scope of the invention.

The embodiments of the invention in which an exclusive property or privilege is claimed are defined as follows:

1. An in-line roller skate comprising:

a boot adapted to support a skater's foot, the boot including a molded base having a sole and a heel, the sole including an integrally molded downwardly protruding peg and the heel including an integrally molded downwardly protruding hook;

a sole bracket attached to the sole with a first fastener separate from the peg, said sole bracket including a close fitting peg recess for engaging the peg so that the peg aligns the sole bracket on the boot, said sole bracket being aligned and restricted from movement laterally and longitudinally with respect to said base by the engagement of said peg and said peg recess, said peg not restricting vertical movement of said base relative to said sole bracket;

a heel bracket attached to the heel with a second fastener separate from the hook, said heel bracket including a close fitting hook recess engaging the hook so that the hook aligns the heel bracket on the boot, said heel bracket being aligned and restricted from movement laterally and longitudinally with respect to said base by the engagement of said hook and said hook recess;

a frame releasably attached to the sole bracket and heel bracket; and a plurality of in-line roller wheels rotatably mounted in the frame.

2. The in-line roller skate of claim 1, wherein the frame is adjustably attached to the sole bracket and heel bracket.

3. The in-line roller skate of claim 2, wherein the sole and heel brackets include a downwardly extending wall having slots and wherein the frame is slidably mounted in the slots.

4. The in-line roller skate of claim 1, wherein a mounting surface on the sole and the sole bracket are sloped upwardly from the back of the sole to the front of the sole at an angle of from approximately three to seven degrees.

5. An in-line roller skate comprising:

a boot adapted to support a skater's foot and including a base having a sole and a heel, the sole including a first downward projection formed integrally therewith, the heel including a second downward projection formed integrally therewith;

a sole bracket for mounting on the sole, said sole bracket including a sole recess for close fitting mating engagement with said first downward projection and a sole bracket fastener separate from said first downward projection, said first downward projection aligning said sole bracket laterally and longitudinally, such that said sole bracket is not movable laterally and longitudinally with respect to said sole once said first downward projection is engaged therewith;

a heel bracket for mounting on the heel, said heel bracket including a heel recess for close fitting mating engagement with said second downward projection and a heel bracket fastener separate from said second downward projection;

a frame attached to the sole and heel brackets; and a plurality of in-line roller wheels rotatably mounted in said frame.

6. The in-line roller skate of claim 5, wherein the frame is adjustably attached to the sole and heel brackets.

7. The in-line roller skate of claim 5, wherein the frame, sole bracket, and heel bracket are formed as a unitary piece.

* * * * *

UNITED STATES PATENT AND TRADEMARK OFFICE

CERTIFICATE OF CORRECTION

PATENT NO. : 5,549,310

DATED : August 27, 1996

INVENTOR(S) : A.A. Meibock et al.

It is certified that error appears in the above-indentified patent and that said Letters Patent is hereby corrected as shown below:

Title page item,

| | | |
|---|---|---|
| [56] Pg. 1, col. 2 | Refs. Cited (U.S. Pat. Docs.) | Insert the following reference: --5,129,663 7/1992 Soo . . . . . 280/7.14-- |

Signed and Sealed this

Tenth Day of December, 1996

Bruce Lehman

*Attest:*

BRUCE LEHMAN

*Attesting Officer*

*Commissioner of Patents and Trademarks*